United States Patent [19]

Cattani, II

[11] 4,331,945

[45] May 25, 1982

[54] MAGNETICALLY ACTUATABLE TAMPER SWITCH ASSEMBLY

[76] Inventor: Cyrus J. Cattani, II, 885 Piper La., Yardley, Pa. 19067

[21] Appl. No.: 189,879

[22] Filed: Sep. 23, 1980

[51] Int. Cl.[3] ..... H01H 36/00

[52] U.S. Cl. ..... 335/205

[58] Field of Search ..... 335/205, 153, 154, 84, 335/85, 137, 229, 302, 255, 278; 200/61.93, 81.9 M, 82 E, 67 F; 337/54, 90, 134, 344; 338/12; 339/12

[56] References Cited

U.S. PATENT DOCUMENTS

| | | | |
|---|---|---|---|
| 2,289,830 | 7/1942 | Ellwood | 335/152 X |
| 3,292,123 | 12/1966 | Siklos | 335/205 |
| 3,579,159 | 5/1971 | Posey | 335/205 |
| 3,622,926 | 11/1971 | Risk | 335/205 |
| 3,710,369 | 1/1973 | Takahashi | 340/274 |
| 3,736,397 | 5/1973 | Pedersen | 200/169 PB |
| 3,792,389 | 2/1974 | Murphy | 335/205 |
| 3,828,910 | 8/1974 | Glay | 197/98 |
| 3,829,803 | 8/1974 | Maeda | 335/205 |
| 3,896,404 | 7/1975 | Peterson | 335/205 |
| 3,932,718 | 1/1976 | Porat | 200/61.93 |
| 3,937,913 | 2/1976 | Soulas | 200/302 |
| 4,012,611 | 3/1977 | Petersen | 200/61.45 R |
| 4,012,731 | 3/1977 | Solomon | 340/274 R |
| 4,041,427 | 8/1977 | Chusha | 335/205 |
| 4,072,917 | 2/1978 | Haas et al. | 335/205 |
| 4,117,430 | 9/1978 | Sims | 335/205 |
| 4,130,745 | 12/1978 | Hetzer | 200/82 E |
| 4,186,362 | 1/1980 | Kondo et al. | 335/205 |

*Primary Examiner*—L. T. Hix
*Assistant Examiner*—S. D. Schreyer
*Attorney, Agent, or Firm*—David H. Semmes; Warren E. Olsen

[57] ABSTRACT

A magnetically actuatable tamper switch assembly comprising a housing of nonmagnetizable material as elongated in a longitudinal direction, wherein a plunger is operable to be longitudinally moved through an aperture in the first end of said housing, wherein the improvement comprises substituting the mechanical wiper contacts of prior art tamper designs with an elongated bar magnet and associated elongated reed switch set of components. The present invention uniquely takes advantage of both the interior housing space available in the conventional tamper switch housing and also the reaction of an overlapping reed switch region to the lines of flux which eminate from a given pole of a magnet material. The magnet is moved parallel to the longitudinal movement of the axis, and the magnet is magnetized in a direction parallel to that longitudinal axis, so that it will approach a transversely disposed switch element in an offset manner, to ensure that as the magnet is urged towards the second end of the housing, and into proximity with the reed switch, the magnetic fluxes will be strongest upon only one of the two reeds, to thereby generate an attractive force between the reeds, and close an electrical circuit between the two electrical contacts also mounted at the second end of the housing.

9 Claims, 3 Drawing Figures

MAGNETICALLY ACTUATABLE TAMPER SWITCH ASSEMBLY

BACKGROUND OF THE INVENTION

1. Summary of the Invention

This invention relates to an improved tamper switch assembly, wherein the mechanical wiping contacts of known tamper switch designs are removed, and replaced by a magnetically actuatable switch assembly, and associated bar magnet. In the preferred embodiment, a standardized tamper switch housing is employed so that the present invention can have widest applicability for replacement of mechanical wiper type tamper switches assembly, without necessitating any modification to mounting arrangements now fairly standarized in the industry, for tamper switches.

As a matter of background, tamper switches are very commonly used with respect to alarm systems, and a given alarm externally mounted bell box, for example, will have a first tamper switch to indicate whether an access door is being opened, and a second tamper switch to indicate whether the entire box is being removed from its mounting surface. Because such bell boxes are exposed to marine atmospheres, and severe weather environments generally, prior experience with known and available forms of tamper switches has been very disappointing. The present invention predicates significant improvement upon the state of the prior art in tamper switches, through an invention which is characterized by maintaining, completely, the external geometry of conventional tamper switches, while only changing the interior functioning of the device to not only eliminate mechanical wiping of parts, but also to produce an unexpected function which was unexpected and particularly advantageous in its intended applications.

2. Brief Description of the Prior Art

Prior workers have designed magnetic reed switches in various formats, to solve particular problems. To the best knowledge of applicant there has been no realization that a certain juxtapositioning of magnet and switch elements, inside of a conventional tamper switch geometry, would produce the results which are taught herein.

Current known prior art devices are shown in the U.S. Pat. Nos., as follows:

Ellwood: 2,289,830
Posey: 3,579,159
Risk: 3,622,926
Takahashi: 3,710,369
Pedersen 3,736,397
Murphy: 3,792,389
Glay: 3,828,910
Maeda: 3,829,803
Peterson: 3,896,404
Porat: 3,932,718
Soulas et al.: 3,937,913
Peterson: 4,012,611
Solomon: 4,012,731
Chusha: 4,041,427
Haag et al.: 4,072,917
Sims, Jr.: 4,117,430
Hetzer: 4,130,745
Kondo et al.: 4,186,362

Various of the switch concepts illustrated in these patents eliminate a need for a wiping contact arrangement in a switch, by substitution of a non-contact arrangement, wherein a permanent magnet is moved proximate a sealed glass reed switch element. The Ellwood patent illustrates an early teaching on the concept of a reed switch, and is noted to illustrate the type of switch element which the present invention uses in a unique manner.

The Posey patent is particularly helpful to understanding of one unexpected feature of the present invention, in that his FIGS. 7 and 8 illustrate certain known interactions between reed switch contacts, which have high magnetic permeability and low magnetic retentivity, and a magnetic flux. It is the particular concern of the teachings in Posey to place a magnet so there will be a null position, wherein the switch will remain open, this occurs when the same polarity field enters both reed switch elements due to the symmetrical placement of his particular ceramic magnet proximate the overlap of the two reed elements. In direct contrast to the teachings of Posey, the present invention arranges the geometry of the device so that the movement of its plunger will be from a position where the contact reeds of the switch element are substantially unaffected by the magnetic fluxes of an elongated bar magnet, to a position where the one pole of the magnet is moved into proximity with only one of the blades inside of the encapsulated reed switch, to thereby oppositely polarize the two blades of the switch, and generate an attractive force between the blades which closes a circuit. The present invention focuses upon creating different longitudinal stations, depending on direction of movement, before a state of actuation changes.

The Takahashi patent illustrates a combination wherein a reed assembly is incorporated into a framework device, and is noted simply to illustrate one known alarm system application for reed switches.

The Pedersen patent illustrates a keyboard switch assembly application, wherein the improvement involves preventing formation of a partial vacuum when a key is pressed against a resilient surface, and also illustrates a bar magnet being moved in a parallel manner to a reed switch, by an actuating member.

The Glay patent illustrates different improvements in a keyboard design, such as that previously taught by Pedersen, and is also not particularly concerned with the problem which is addressed and solved by the present application. The present teachings are for a particularly long actuation stroke and geometry so the switch tends to remain closed to a point on its return stroke, that is above the point of closure of its actuating stroke.

The patent to Murphy, as well as the patent to Risk, illustrate a particular improvement wherein a reed switch is mounted longitudinally, and parallel with respect to the motion of a particular magnet. In contrast, the present invention is predicated upon the transverse mounting of a reed switch, wherein further the bar magnet, (which is both longitudinally disposed and also polarized in directions parallel to its axis) will be moved proximate only one end of the switch.

Takahashi and Peterson '404 both illustrates forms of architectural devices, wherein a magnetic switch is incorporated into either a framework, or a hinge, for example, and are examples of known, unique geometrical relationships using reed switch technology. The Maeda patent illustrates a seat detecting device, wherein particular pressure requirements in detecting presence of a person on a seat dictate that a bar magnet should be parallel to the reeds of a reed switch, with the spatial relationships between the reed and the magnet also contrary to the problem which is addressed and solved by the present invention. Similarly, Peterson '611 illustrates one specific pendulum-type juxtapositioning magnet and reed switch, to determine inertia changes, and further illustrates unexpected results are obtained by unique orientations of magnets and reed switches.

The Haag et al. patent illustrates another hinge including a reed switch assembly, wherein the cooperation of the elements appears hidden to the average observer.

The Solomon patent is noted to illustrate a self-contained burgular alarm system comprising a power source and certain motion sensing devices, and to show the category of devices for which the present invention teaches an improvement.

The patents to Chusha and Sims, Jr. illustrate fairly recently patented keyboard designs, wherein magnets are used to complete a circuit device. Chusha is helpful to understand the present invention insofar as it predicates improvement through disposing the n-s direction of a magnet oblique to the longitudinal direction of the reeds of a reed switch. The Chusha patent, as well as the previously-discussed patent to Posey, are helpful background to appreciate the magnetic fluxes generated by different polarity formats (see FIGS. 1 and 4 of Posey, for example), and one aspect of the present invention is to take advantage of the differential in a magnetic flux field.

The keyboard switch patent to Sims, Jr., as well as the intrusion detector patent to Porat, are further examples of unexpected results from particularly orienting a plunger and a magnet. Sims, Jr. teaches a plastic plunger that is magnetized in a circular manner, wherein the polymeric host material has iron particles suspended therewithin, and are ordered to produce a magnetic field which varies with the location of the actuator. The Porat patent illustrates a conventional bar magnet/reed switch arrangement wherein the magnet is moved parallel to the elongated direction of a reed switch, and illustrates prior efforts to develop a switching for only slight motions of the actuating device.

Finally, the Soulas et al. patent is noted to illustrate one inventor's approach to the problem of corrosion around a switch, through adaption of seals to a magnetically actuatable switch design.

SUMMARY OF THE INVENTION

The present invention is characterized by avoiding, in a categorical fashion, the corrosion problems inherent to tamper switches in their intended use. The present invention is also particularly adapted as a retrofit design for existing tamper switches. As will be shown hereafter, the geometry of standardized tamper switch housings lend themselves particularly well to the actuation concept and mechanism which is employed for unique advantage in the present invention.

The present invention essentially comprises a housing of a nonmagnetizable material which is elongated in a longitudinal direction from a first end to a second end, so that a plunger can protrude, and be longitudinally moved, through an aperture in the first end. Such conventional tamper switch housing designs, allow atmospheric pollution to enter past the annulus between the plunger and the aperture in the first end of the housing, and pit and corrode the mechanical wiping action between two copper blades and a copper plate.

The present invention replaces both of the relatively elongated copper blades, and also the copper plate, mounted about the plunger, with a magnet and a reed switch assembly which is located on the opposite, or second end of the housing. At least one elongated bar magnet is fixedly connected, in an offset manner, on one traverse side of the plunger, so that the longitudinal axis of the magnet is substantially parallel to the longitudinal axis of the plunger. It should also be understood that the present invention employs a magnet which is magnetized in the direction parallel to its longitudinal axes.

A second aspect of the present improved tamper switch is at least one elongated reed switch element, of the type having two contact reeds encapsulated therein, wherein the reed switch element is disposed with its longitudinal axis transverse to the housing. This elongated reed switch is in respective electrical contact between the two electrical connections conventionally found at the second end of a tamper switch housing, and according to the preferred embodiment, the two contact reeds within the switch element are disposed so the overlap between the reeds is substantially symmetrical with respect to the longitudinal axis of the plunger. This geometry renders the region of overlap substantially offset with respect to the North/South polar orientation of the associated bar magnet.

The present invention advantageously employs a compression spring means to normally urge plunger element to a first position, whereat the distal end of the bar magnet is relatively removed from the reed switch assembly, and its magnetic fluxes are inaffective to polarize either contact reed of the switch element. The spring means, which may be a conventional tamper switch spring, is operable to be overcome when the plunger is moved longitudinally to, and below, a second position where at the distal end of the magnet is moved into a relative proximity with only one of the contact reeds, to thereby generate an attractive force between both reeds, and thereby close an electrical circuit between the two electrical contacts. As noted hereinbefore, reed switches are well known and are characterized by reeds having high magnetic permeability and low magnetic retentivity, to thereby be responsive to the relative proximities of a magnetic flux. As illustrated by the patent to Posey, for example, it is not enough that any magnet be moved relatively proximate to the reed switch housing as a whole. For example, if the north pole of the magnet is moved perpendicular to the overlap of the reeds, both contact reeds of the switch element will be equally permeated by the polarity field flowing out of that pole of the magnet, and since both of the reeds will be experiencing the symmetrical distribution of the magnetic flux from the north pole of that magnet, there will be no actuation between the two reeds. The present invention takes advantage of this basically known fact by defining a geometry for a tamper switch wherein the down and up longitudinal movements of the plunger assembly will result in different actuation and deactuation points for the magnet, which is particularly advantageous considering the rigors and intended use of the present invention.

The present invention is particularly designed as an improved tamper switch, and as hereinbefore noted, these switches are commonly mounted upon alarm boxes which are exposed to the elements, including strong winds and other sources of vibration. Hence, it happens that a small relative movement between the two elements respectively holding a tamper switch closed results in a false open circumstance, and because of factors which are not truly indicative of someone tampering with the box, for example. Accordingly, it is desirable that the switches be somewhat forgiving in a given range of longitudinal movement of the actuator or plunger, and the present invention advantageously, and surprisingly, allows the plunger to close the reed switch at a second longitudinal position, and not open those reed blades until the plunger has moved substantially above that second position, to a third position which is relatively closer to the first, or normally open position.

Hence, the primary object of the present invention is to provide a tamper switch that can be quickly mounted, as in a replacement fashion, for tamper switches which have failed or become unreliable in use, and also to ensure that the level of the reliability in actuation confidence levels is greatly improved over current mechanical wiping designs.

It is a related object of the present invention to teach a tamper switch assembly with a given range, which may be considered a bounce range, wherein no change of the prior state of actuation will occur.

It is a third and related object of the invention to teach a manner of retrofitting existing tamper switch housings with replacement elements of the present invention, to get increased and unobvious advantages in operation.

Further objects, advantages and features of the present invention will become more apparent by reference to the following detailed description, wherein reference is made to the accompanying drawings.

DESCRIPTION OF THE PREFERRED EMBODIMENT

Figure 1:
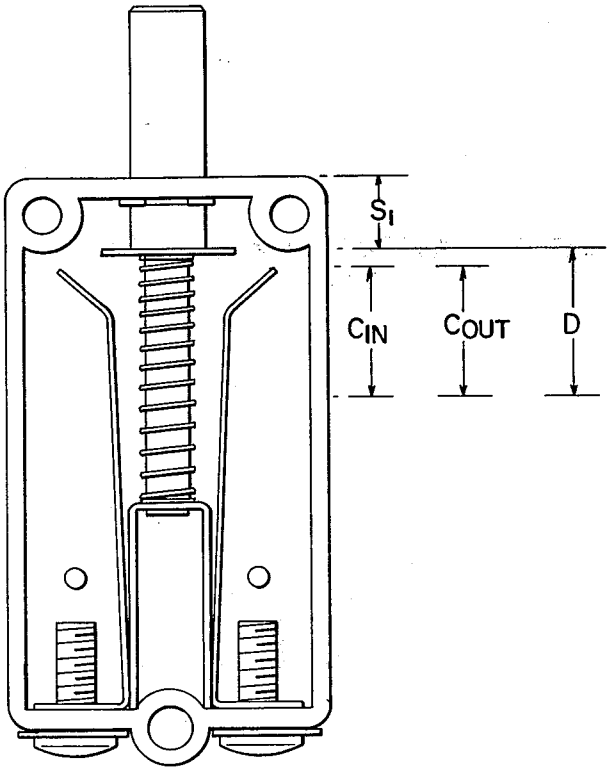
FIG. 1 (PRIOR ART)
FIG. 1 illustrates, in plan view, a prior art type of reed switch assembly, upon which the present invention predicates improvement.

FIG. 1 illustrates the current widely available type of tamper switch which is used in all alarm systems, for example. Such tamper switches are known to be manufactured by two companies, Alarm Device Mfg. Co. of Syosset, New York and Amseco, of Japan.

The present invention incorporates the total exterior geometry of such known tamper switch designs, and improves functional reliability without the need to alter that geometry. With reference to FIG. 1, it can be appreciated that the tamper switch includes a copper plate, shown at position $S_1$, which, upon being longitudinally urged downward, will first contact and then wipe between the two longitudinally extending blades illustrated. This wiping action will occur during a contact phase which is illustrated, in FIG. 1, as C-in, and remain closed for an equal plunger return to the open position, shown as C-out.

Figure 2:
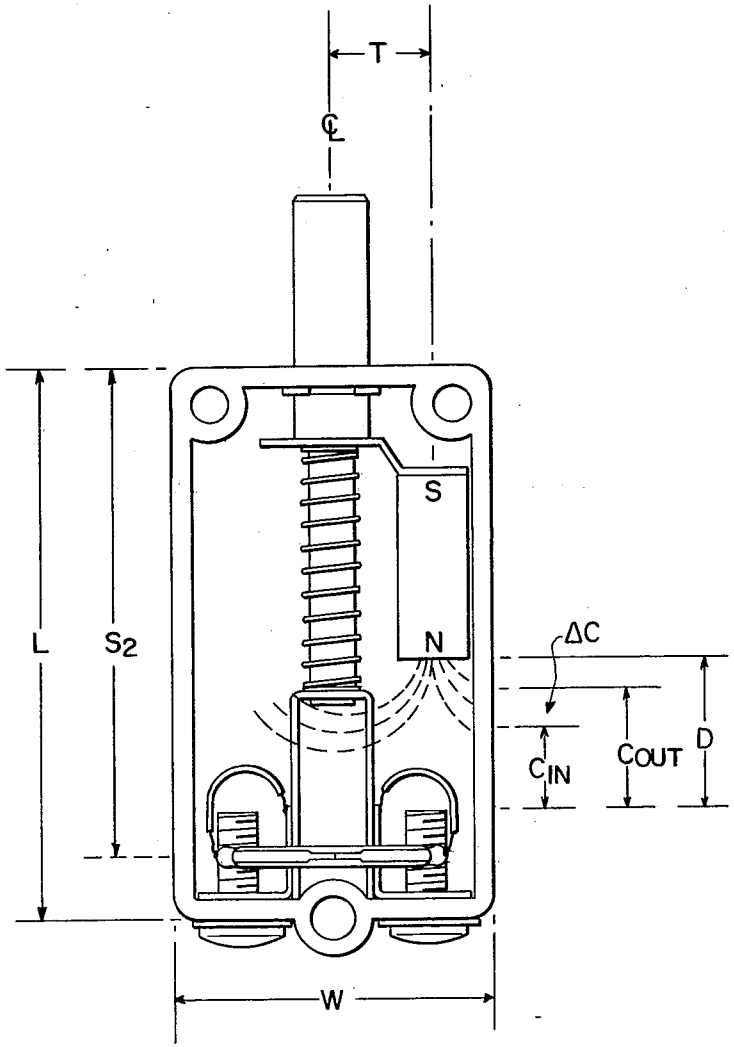
FIG. 2 is a plan view of a preferred embodiment of the present invention, illustrating the basic operating aspects of the present invention.

By contrast, an illustration of the preferred embodiment of the present invention is shown in FIG. 2, wherein the external mounting aspects are identical with conventional devices, however the internal operating devices are completely removed. The longitudinal housing dimension, from a first end, to a second end, is shown as L, with the relative position of the reed switch mechanism shown at $S_2$, or substantially opposite the housing aperture through which the plunger of the device communicates with the outside. As also shown, the elongated bar magnet has a distal end which travels a distance D, which is identical to the distance D allowed the plunger in the prior art device of FIG. 1. Hence, for an identical amount of travel of the plunger, one would expect that there also be identically equal actuation ranges, from a simple substitution of parts. However, FIG. 2 illustrates that because of the polarity of the bar magnet, and its lateral offset mounting with respect to the overlapping reeds of the reed switch element, there will be a range of actuation upon depression, C-in, which begins later, and is substantially shorter than the amount of maintained contact which exists when the plunger is being returned to its normal position, as labeled C-out. This is advantageous since firstly, it assures that when a device is being mounted in use, an electrical test will only indicate a positive closure if the plunger has moved to within the C-in range, which is smaller than the distance of closure which will exist upon a return stroke of the plunger. As a related advantage, if there is a vibration circumstance and the plunger has just begun to enter the C-in range, its closure state will not be destroyed by a slight pertubation or outward movement, since C-out exists to a vertically upward or third position which is slightly above the second, or inward contact point illustrated in FIG. 2. The present invention is believed to particularly enhance this reaction through the basic juxtapositioning of the magnetic fluxes and the reed switch, as will now be described.

As noted hereinbefore, the Posey patent recognized the advantages of a null position for a ceramic type magnet with respect to the overlapping of reeds. The present invention takes an exactly opposite approach. The lines of force, or lines of magnetic flux, which emanate, for example, from the north end of a ferrite, bar magnet, will show intensities which may vary inversely with the transverse distance of points from the north pole. Accordingly, by moving the pole in a constrained fashion, so that it is always offset with respect to the overlap of the reeds, it is assured that the left-most reed will always be in a field of lower flux or intensity than will the right reed. Furthermore, even though the right-most reed, (which is the proximate reed from close movement of the north pole of the magnet), has an "open" spring bias, the spacing taught nonetheless ensures that the flux changes experienced by that reed will delay a reopening, until the magnet pole has reached the third position, approximately $\frac{1}{8}$ inch above the second position.

Figure 3:
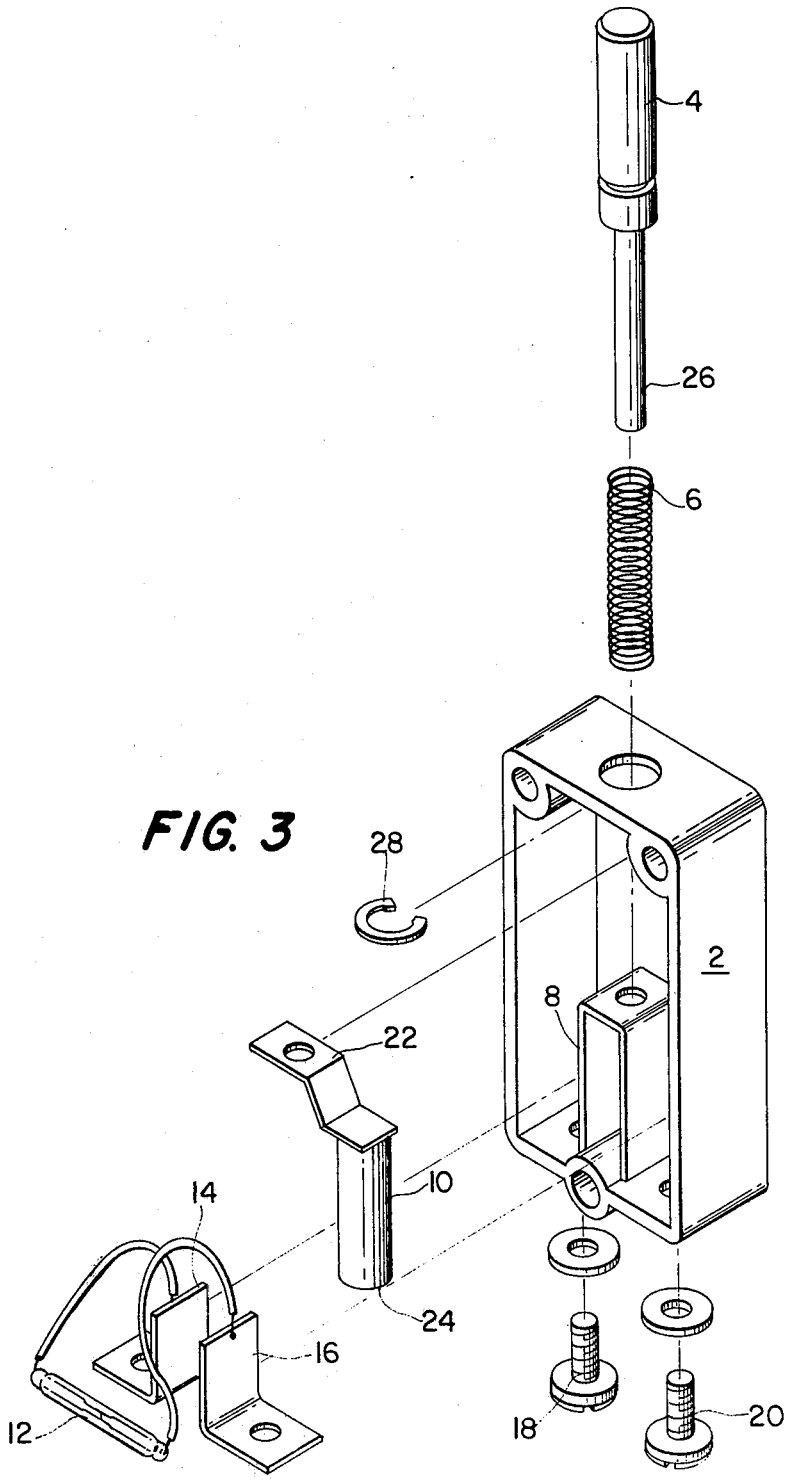
FIG. 3 is a sectional explosion view, in elevation, of the respective parts of the present invention, according to a preferred embodiment.

To further describe the preferred embodiment of the present invention, an explosion view of the respective parts illustrated in FIG. 2 is shown in FIG. 3, and will now be described. As shown in FIG. 3, the invention essentially comprises a housing, 2, of non-magnetizable material, which is elongated in a longitudinal direction from a first end to a second end. A plunger, 4, elongated in the same longitudinal direction, is operatively mounted for longitudinal movement through an aperture, as shown in the upper or first end of the housing in FIG. 3.

An elongated bar magnet, 10, is fixedly connected, in an offset manner, to one transverse side of the plunger, with the longitudinal axis of the magnet being substantially parallel to the longitudinal axis of the plunger. The magnet may be of iron, nickel, cobalt or similar materials and is magnetized in a direction parallel to its longitudinal axis. For example, the distal end of the magnet, 24, is a north pole, and the proximate end, which is attached to the laterally extending support, 22, the south end of the magnet. In the preferred embodiment, the bar magnet is on the order of approximately a quarter inch in diameter, and one half inch in length. Such magnets are conventional, and may be purchased off-the-shelf from Per-Mag, of Hempstead, New York. Any similarly polarized form magnet will also work, and the present invention does not absolutely require a particular magnetic field value, since it is the differentiation of flux at transverse points from the magnet pole which ensures successful operation of the device.

The second major element of the preferred invention is at least one elongated reed switch element, 12, of conventional type having two contact reeds encapsulated therein, for example, one of the 400 series of Componex, of Lakewood, New Jersey. The switch longitudinal axis is mounted transversely to the axis of the housing, furthermore, the reed switch element is preferably mounted proximate the second end of the housing, the same end where two electrical connections, 14 and 16, exist for respective screw connection to an external circuit, as by conventional tamper switch screws, 18 and 20. As shown in FIGS. 2 and 3, the two contact reeds within the switch element are disposed with the overlap substantially symmetrical with respect to the longitudinal axis of the plunger; to render the overlap substantially transversely offset with respect to the longitudinal motion of the bar magnet.

Again, as in conventional tamper switches, a spring means, 6, is used to normally urge the plunger element to a first position (FIG. 1), where the magnet is proximate the first end of the housing, so that its magnetic flux is then ineffective to polarize either contact reed of the switch element. The spring is sized to allow the plunger to move longitudinally to and below a second position, C-in, where the distal end of the magnet, e.g., the north pole, becomes proximate only one of the contact reeds, and thereby will generate an attractive force between both reeds, to close an electrical circuit between the two electrical contacts, 14 and 16.

The plunger is constrained for upward motion by a C-ring, 28, which also conveniently allows the assembly to be easily inserted, according to the explosion view of FIG. 3. The housing, which is of a non-magnetizable material, such as plastic, contains the same external mounting bosses as standard and conventional for prior art tamper switches, for example the prior art device illustrated in FIG. 1. It has been found that the relatively elongated dimension of the housing is of a particular advantage, since the present invention teaches that a bar magnet must be longitudinally mounted in a transverse offset relationship to the center line of the switch, and this mounting assures that the magnetic flux being generated out of the distal end of the magnet, 24, will have a transverse variation in intensity that is sufficient to impose an attractive force between the two reeds, as discussed hereinbefore. The housing also includes an interior housing support, 8, proximate the second end of the housing, which is both adapted to guide a lower end of the plunger, 26, and also to act as a support for both the transversely mounted switch element, 12, as well as the bottom end of the compression spring, 6. In the preferred embodiment the spring means further comprises a compression spring, 6, that is simply mounted between the upper surface of the interior housing support, 8, and the lower surface of the transversely extending support arm, 22, which holds the proximate end of the bar magnet, 10.

As also shown with reference to both FIGS. 2 and 3, the distal end of the bar magnet, 24, is normally spaced approximately mid-way between the first and second ends of the housing, with the reed switch element being mounted substantially parallel to, and outside of a plane defined by the respective longitudinal axes of the plunger and the bar magnet. This mounting ensures that the transverse, or offset, distance between the free pole of the magnet, and the overlap region of the reeds is sufficient to ensure that the magnetic flux generated by the approaching pole of the magnet is operable to maintain an attractive force between the reeds when the plunger is allowed to return, (from or below that position wherein the fluxes were sufficient to close the reeds), to a third position, above that closure position, where the reeds will finally open. The resulting bounce region, C, ensures that misalignments of the housing with respect to the member which contacts the upper end of the plunger will not seriously compromise the operation of the device, since the device will tend to stay in its previous state as it is being respectively opened or closed. This is an advantage in a vibrating environment, for example, and avoids an unstable axial position of the plunger, where there will be rapid opening and closing of the switch, due to vibration or other cause.

While a preferred embodiment of my invention has been illustrated and described, it is to be understood that the invention is to be defined by scope of the appended claims.

I claim:

1. A magnetically actuatable tamper switch assembly comprising:

a housing of nonmagnetizable material which is elongated in a longitudinal direction from a first end to a second end, wherein a plunger elongated in the longitudinal direction is operatively mounted for longitudinal movement through an aperture in said first end;

an elongated bar magnet fixedly connected, in an offset manner, on one transverse side of said plunger, with the longitudinal axis of said magnet substantially parallel to the longitudinal axis of said plunger, with said magnet being magnetized in a direction parallel to its longitudinal axis;

at least one elongated reed switch element, of the type having two contact reeds encapsulated therein, disposed with its longitudinal axis transverse to said housing and mounted proximate to the second end of said housing, and in electrical contact between two electrical connections proximate the second end of said housing, wherein the two contact reeds within said switch element are disposed with an overlap substantially symmetrical with respect to the longitudinal axis of said plunger, and thereby transversely offset with respect to the longitudinal motion of said bar magnet;

spring means to normally urge said plunger element to a first position wherein said magnet is proximate the first end of said housing, whereat its magnetic fluxes are ineffective to polarize either contact reed of said switch element, while operable to allow said plunger to move longitudinally to and below a second position, where by the magnet is urged proximate the second end of said housing, and into proximity with only one of said contact reeds, thereby to generate an attractive force between said reeds and close an electrical circuit between said two electrical connections wherein further, the transverse offset distance of said magnet with respect to said plunger is sufficient to ensure that the magnet fluxes generated by said magnet are operable to maintain said attractive force between said reeds as said plunger is allowed to return from or below said second position to a third position, longitudinally spaced above said second position.

2. A tamper switch according to claim 1 wherein said nonmagnetizable material is a plastic and said housing contains external mounting bosses for securing said switch in a conventional fashion to alarm boxes, and like applications for a tamper switch.

3. A magnetically actuatable tamper switch assembly comprising:

a housing of nonmagnetizable material which is elongated in a longitudinal direction from a first end to a second end, wherein a plunger elongated in the longitudinal direction operatively is mounted for longitudinal movement through an aperture in said first end;

an elongated bar magnet fixedly connected, in an offset manner, on one transverse side of said plunger, with the longitudinal axis of said magnet substantially parallel to the longitudinal axis of said plunger, with said magnet being magnetized in a direction parallel to its longitudinal axis and a proximate end of said bar magnet mounted to an offset arm which in turn extends transversely to a mounting that is proximate an upper end of said plunger, wherein said housing further comprises an interior housing support, proximate the second end of said housing, which is adapted to guide a lower end of said plunger during its longitudinal movement;

at least one elongated reed switch element, of the type having two contact reeds encapsulated therein, disposed with its longitudinal axis transverse to said housing and mounted proximate to the second end of said housing, and in electrical contact between two electrical connections wherein the two contact reeds within said switch element are disposed with an overlap substantially symmetrical with respect to the longitudinal axis of said plunger, and thereby transversely offset with respect to the longitudinal motion of said bar magnet;

spring means, which comprises a compression spring mounted between said interior housing support and said offset arm, to normally urge said plunger element to a first position wherein said magnet is proximate the first end of said housing, whereat its magnetic fluxes are ineffective to polarize either contact reed of said switch element, while operable to allow said plunger to move longitudinally to and below a second position, whereby the magnet is urged proximate the second end of said housing, and into proximity with only one of said contact reeds, thereby to generate an attractive force between said reeds and close an electrical circuit between said two electrical connections.

4. A tamper switch according to claim 3 wherein the distal end of said bar magnet is spaced, in the normal switch position, approximately mid-way between the first and second ends of said housing and said reed switch element is mounted substantially parallel to, and outside of a plane defined by the respective longitudinal axes of said plunger and bar magnet.

5. A tamper switch according to claim 4 wherein said switch element is supported against a portion of said interior housing support and spans the lateral distance between two blade and screw assemblies which further comprise said electrical connections.

6. In a tamper switch assembly of the type wherein a housing is elongated in a longitudinal direction from a first end to a second end, and a plunger elongated in the longitudinal direction is operatively mounted for longitudinal movement through an aperture in said first end, the improvement which comprises:

an elongated bar magnet fixedly suspended, in an offset manner, from a support extending transversely from said plunger, wherein the longitudinal axis of said magnet is substantially parallel to the longitudinal axis of said plunger, and said magnet is magnetized in a direction parallel to its longitudinal axis; and at least one elongated reed switch element, of the type having two contact reeds encapsulated therein, disposed with its longitudinal axis transverse to said housing, said switch mounted proximate said second end and in electrical contact between two electrical connections at the second end of said housing, wherein the two contact reeds are disposed with an overlap substantially symmetrical with respect to the longitudinal axis of said plunger and thereby transversely offset with respect to the longitudinal motion of said bar magnet;

whereby movement of said plunger from a first position, wherein the distal end of said magnet is proximate the mid point of said housing, to and below a second position, wherein the distal end of said magnet is proximate to one of said contact reeds, generates an attractive force between said reeds and closes an electrical circuit between said two electrical connections.

7. A tamper switch according to claim 6 wherein said housing is of an unmagnetizable material and of the type wherein external mounting bosses for securing said tamper switch in a conventional fashion to alarm boxes, and like applications for tamper switches, are located proximate the first and second ends of said housing, wherein further the transverse offset distance of said magnet with respect to said plunger is sufficient to ensure that the magnetic fluxes generated by said magnet are operable to maintain the attractive force between said reeds when said plunger is allowed to return from or below said second position to a third position, that is longitudinally spaced thereabove.

8. An improved tamper switch according to claim 7, wherein a spring means is supplied to normally urge said plunger towards said first position, so that said reed switch will normally be outside of the magnetic flux to said bar magnet, and further said reed switch element is now substantially parallel to, and outside of a plane defined by the respective longitudinal axes of said plunger and bar magnet.

9. A tamper switch according to either claim 5 or 6, wherein said housing is symmetrical about the longitudinal axis of said plunger and said support is operable to be located in offset relationship to the longitudinal axis of said plunger on either side of said plunger.

* * * * *